US011976531B2

(12) United States Patent
Reid

(10) Patent No.: US 11,976,531 B2
(45) Date of Patent: May 7, 2024

(54) APPARATUS AND METHODS FOR USE IN WELLBORE PACKING

(71) Applicant: Weatherford U.K. Limited, Leicestershire (GB)

(72) Inventor: Stephen Reid, Aberdeen (GB)

(73) Assignee: WEATHERFORD U.K. LIMITED, Leicestershire (GB)

( * ) Notice: Subject to any disclaimer, the term of this patent is extended or adjusted under 35 U.S.C. 154(b) by 0 days.

(21) Appl. No.: 17/072,926

(22) Filed: Oct. 16, 2020

(65) Prior Publication Data

US 2021/0032954 A1 Feb. 4, 2021

Related U.S. Application Data

(62) Division of application No. 15/701,591, filed on Sep. 12, 2017, now Pat. No. 10,837,256.

(30) Foreign Application Priority Data

Sep. 15, 2016 (GB) ..... 1615744

(51) Int. Cl.
*E21B 33/128* (2006.01)
*E21B 23/06* (2006.01)
(Continued)

(52) U.S. Cl.
CPC ..... *E21B 33/128* (2013.01); *E21B 23/06* (2013.01); *E21B 33/1208* (2013.01);
(Continued)

(58) Field of Classification Search
CPC .... E21B 33/128; E21B 33/1285; E21B 43/04; E21B 43/045
See application file for complete search history.

(56) References Cited

U.S. PATENT DOCUMENTS 3,422,898 A 1/1969 Conrad
6,318,465 B1 * 11/2001 Coon ..... E21B 43/088 166/278
(Continued)

FOREIGN PATENT DOCUMENTS

EP 2184436 A2 5/2010
EP 2407633 A2 1/2012
(Continued)

OTHER PUBLICATIONS

Office Action received in counterpart Azerbaijan Application No. a 2017 3111, dated May 7, 2019, 3 pages.
(Continued)

*Primary Examiner* — Blake Michener
(74) *Attorney, Agent, or Firm* — Cabello Hall Zinda, PLLC

(57) ABSTRACT

An apparatus for use in a well borehole packing operation takes the form of a downhole packer and comprises a body and a seal member. In use, the apparatus is run into a borehole as part of a downhole completion assembly. On reaching the desired location, the apparatus is activated to urge the seal member into sealing engagement with the borehole, and thereby isolate an annular region between the apparatus and the borehole. A conduit is disposed within the body and is offset from a central longitudinal axis of the apparatus, the conduit configured to transport a borehole packing material, such as gravel slurry, through the apparatus.

8 Claims, 13 Drawing Sheets

(51) Int. Cl.

| | |
|---|---|
| ***E21B 33/12*** | (2006.01) |
| ***E21B 33/126*** | (2006.01) |
| ***E21B 43/04*** | (2006.01) |
| *E21B 33/127* | (2006.01) |

(52) U.S. Cl.
CPC ..... *E21B 33/126* (2013.01); *E21B 33/127* (2013.01); *E21B 43/04* (2013.01)

(56) References Cited

U.S. PATENT DOCUMENTS

| | | | | |
|---|---|---|---|---|
| 2004/0112609 | A1 | 6/2004 | Whanger et al. | |
| 2004/0140089 | A1* | 7/2004 | Gunneroed | E21B 43/08 166/228 |
| 2007/0012460 | A1* | 1/2007 | Coronado | E21B 33/1285 166/387 |
| 2009/0065192 | A1 | 3/2009 | Lucas | |
| 2010/0032158 | A1 | 2/2010 | Dale et al. | |
| 2010/0236775 | A1 | 9/2010 | Serve et al. | |
| 2010/0300687 | A1* | 12/2010 | Watson | E21B 43/04 166/278 |
| 2011/0139465 | A1 | 6/2011 | Tibbles et al. | |
| 2011/0155371 | A1* | 6/2011 | Panga | C09K 8/805 166/278 |
| 2013/0248179 | A1* | 9/2013 | Yeh | E21B 43/00 166/278 |
| 2013/0277053 | A1 | 10/2013 | Yeh | |
| 2014/0196914 | A1 | 7/2014 | Ring et al. | |
| 2015/0068743 | A1 | 3/2015 | Broussard et al. | |
| 2015/0198016 | A1* | 7/2015 | Langlais | E21B 17/18 166/51 |
| 2015/0308206 | A1 | 10/2015 | Yue | |
| 2015/0330174 | A1* | 11/2015 | Craigon | E21B 43/25 166/305.1 |

FOREIGN PATENT DOCUMENTS

| | | | |
|---|---|---|---|
| GB | 252853 | A | 6/1926 |
| GB | 2528583 | A | 1/2016 |
| WO | 2008036553 | A2 | 3/2008 |
| WO | 2014158141 | A1 | 10/2014 |
| WO | 2015/119634 | A2 | 8/2015 |

OTHER PUBLICATIONS

Apryatkina S.G, Garaeva M.F, 67th International Young Scientific Conference "Oil and Gas—2013", Apr. 9-12, 2013, Moscow.

Search and Examination Report for counterpart UK Appl. GB 1615744.8, dated Jul. 18. 2017, 8-pgs.

* cited by examiner

APPARATUS AND METHODS FOR USE IN WELLBORE PACKING

FIELD

This invention relates to apparatus and methods for use in well borehole packing operations, in particular but not exclusively gravel packing operations in which an annular region between a downhole completion system and the borehole is packed to mitigate ingress of particulate material into production fluid flows.

BACKGROUND

In the oil and gas production industry, keeping particulate material such as sand and other solids in place and preventing them from entering the wellbore production flow is often critical to improving operational and production efficiency of a given well.

One common and effective means of preventing formation sand from entering the production flow is a gravel packing operation, whereby a gravel slurry containing a proppant and a carrier fluid are pumped downhole, the proppant used to pack the annulus between a production string and the borehole while the carrier fluid is returned to surface. Once in place, the proppant supports the formation at the wellbore and permits production fluid to enter the production string but prevent the ingress of particulate material.

However, there are drawbacks with conventional gravel packing tools and equipment. For example, when packers are incorporated into gravel pack screen assemblies, the quality of packing near the packers is low, providing less support to the wellbore. This can allow release of solids, leading to erosion of screens during the operational life of the well, and in more extreme cases resulting screen failure.

SUMMARY

Aspects of the present invention relate to apparatus and methods for use in well borehole packing operations, in particular but not exclusively gravel packing operations in which an annular region between a downhole completion system and the borehole is packed to support the borehole and mitigate ingress of particulate material into production fluid flows.

According to a first aspect, there is provided a packer apparatus for use in a borehole packing operation, the apparatus comprising: a body; a seal member disposed on the body; an activation arrangement operatively associated with the seal member, the activation arrangement configured to engage the seal member to urge the seal element to a radially extended position relative to the body and thereby reconfigure the apparatus from a first configuration to a second configuration, the seal member comprising a swellable member configured to swell on exposure to a selected reactant and thereby reconfigure the apparatus from the second configuration to a third configuration; and a conduit configured to transport a borehole packing material through the apparatus.

In use, the apparatus may be run into a borehole as part of a downhole completion assembly. On reaching the desired location, the apparatus may be activated to urge the seal member into an expanded or sealing engagement with the borehole, and thereby isolate an annular region between the apparatus and the borehole.

Embodiments of the present invention permit borehole annulus isolation, for example in order to provide selective zonal isolation of a borehole, while permitting borehole packing material to pass axially through the apparatus and thereby facilitate continuous communication of packing material across a plurality of formation zones; without reducing the efficacy of the annular seal provided by the seal member.

Moreover, embodiments of the present invention—for example but not exclusively by virtue of the combination of activation arrangement and swellable seal member—permit the effective length of the apparatus to be reduced compared to conventional packer apparatus. This permits effective borehole isolation while increasing the proportion of the borehole which can be packed—or in other words reducing the proportion of the borehole which, due to the length of the packer apparatus, is typically not packed or which suffers from poor quality packing for the reasons previously described. Embodiments of the present invention thus reduce the possibility of screen erosion which may otherwise result in screen failure. Moreover, by providing a shorter packer apparatus, embodiments of the present invention may also permit isolation of shorter borehole intervals, increasing an operators ability to control access from and/or a given formation zone.

In particular embodiments, the conduit may be disposed or formed within the body of the apparatus. The body may comprise an inner member and an outer member. The conduit may be disposed or formed between the inner member and the outer member.

In particular embodiments, the inner member of the body and the outer member of the body may comprise separate members. However, in other embodiments, the inner member and the outer member may be integrally formed or otherwise comprise a unitary construction.

The inner member may comprise a throughbore defining an axial flow passage through the apparatus. The conduit may be isolated from the throughbore.

The throughbore may be configured to permit downhole tooling and equipment through the apparatus—and in due course oil and/or gas production fluid flows to surface—while the conduit permits the borehole packing material, such as gravel slurry, to be communicated through the apparatus.

The conduit may be annular. Alternatively or additionally, the conduit may be tubular.

A central longitudinal axis of the conduit may be offset relative to a central longitudinal axis of the apparatus. Offsetting the central longitudinal axis of the conduit relative to the central longitudinal axis of the apparatus beneficially provides sufficient capacity to transport the required volumes of packing material without increasing the overall outer diameter of the apparatus.

As described above, the seal member comprises a swellable seal member configured to swell on exposure to a selected reactant. The selected reactant may comprise well fluid, for example.

The seal member may comprise a swelling elastomer. The third configuration may define a radially extended configuration relative to the second configuration. In the third configuration, the seal member may move into sealing engagement with the borehole or, where not already engaged with the borehole, into sealing engagement with the borehole.

The provision of a seal member comprising a swellable seal member beneficially permits the apparatus to isolate a larger borehole annulus, that is the seal member may be capable of sealing across a larger area. Moreover, the provision of a seal member comprising a swellable seal member may assist in conforming the seal member to borehole irregularities or where the borehole is non-circular.

The seal member may comprise a bi-directional seal member, that is a seal member capable or configurable to hold pressure from either side of the seal member.

The seal member may have a sealing surface for forming a seal, in use, with borehole.

The sealing surface may be a portion of the outside surface of the seal member.

The sealing surface may include a profiled portion.

The profile may comprise a corrugated or ribbed profile. Beneficially, a profiled surface may provide a greater available area for contact between the seal member and the borehole. Moreover, a profiled surface may be better suited to sealing with non-uniform surfaces which may be found in open hole applications.

The apparatus may comprise a seal back-up arrangement.

The seal back-up arrangement may be configured to support the seal member in the radially extended position. In use, the seal back-up may support the seal member and prevent or reduce the likelihood of extrusion of the seal member which may otherwise detrimentally affect the seal provided between the seal member and the borehole.

The seal back-up arrangement may comprise a back-up assembly operatively associated with an uphole end of the seal member. The seal back-up arrangement may comprise a back-up assembly operatively associated with a downhole end portion of the seal member.

The back-up assembly or in embodiments comprising a plurality of back-up assemblies at least one of the back-up assemblies may comprise an inner back-up layer having a first portion and a second portion which pivots radially outwards with movement of the seal member. The first portion may be fixed relative to the body. For example, the first portion may be secured to a collar. The second portion may comprise petals.

The activation arrangement may be configured to transition the apparatus from the first configuration to the second configuration.

The activation arrangement may be fluid activated.

The activation arrangement may be pressure activated.

The activation arrangement may be activated by fluid pressure in the conduit.

The activation arrangement may comprise a piston member for engaging the seal member. The piston member may be axially moveable relative to the body.

Embodiments of the present invention—for example but not exclusively by virtue of the combination of the activation arrangement and swellable seal member—may permit the length of the apparatus to be reduced compared to conventional packer apparatus. This permits effective borehole isolation while increasing the proportion of the borehole which can be packed—or in other words reducing the proportion of the borehole which, due to the length of the packer apparatus, is typically not packed or which suffers from poor quality packing for the reasons previously described. Embodiments of the apparatus may thus reduce the possibility of screen erosion which may otherwise result in screen failure. Moreover, by providing a shorter packer apparatus, embodiments of the apparatus may also permit isolation of shorter borehole intervals, increasing the operators ability to control access from and/or a given formation zone.

The apparatus may be configured to be locked in the first configuration.

The apparatus may comprise a lock arrangement for locking the apparatus in the first configuration.

The lock arrangement may comprise a lock piston.

The apparatus may be configured so that the activation piston is prevented from axial movement relative to the body by the lock piston, when the apparatus defines the first configuration.

The lock arrangement may comprise a dog. The apparatus may be configured so that the activation piston is prevented from axial movement relative to the body by the dog, when the apparatus defines the first configuration.

In particular embodiments, the lock arrangement comprises a plurality of dogs.

The dogs may be circumferentially arranged and/or spaced.

The lock arrangement may comprise a retainer for retaining the lock piston. The retainer may comprise a shear pin. In particular embodiments, the lock arrangement may comprise a plurality of retainers. In such embodiments, the retainers may be circumferentially arranged and/or spaced around the body.

The lock arrangement may comprise a retainer. The retainer may be configured to retain the lock piston relative to the body. The retainer may be configured to shear or break in response to a force, for example but not exclusively a fluid pressure force acting on the lock piston, exceeding a selected force threshold.

A rotational lock may be provided. Beneficially, the provision of a rotational lock assists in maintaining rotational alignment between the components of the apparatus. The rotational lock may be disposed between the first member and the second member. The rotational lock may be configured to prevent or limit relative rotation between the first member and the second member. The rotational lock may be configured to permit axial movement of the first member and the second. The rotational lock may be of any suitable form and construction. In particular embodiments, the rotational lock may comprise a pin or screw configured to engage a groove. The screw may be provided in the second member and the groove may be provided in the first member, or vice versa.

The apparatus may comprise a top sub. The top sub may comprise a connector for coupling to a shunt tube or the like. The top sub may comprise a channel for communicating with the conduit.

The apparatus may comprise a bottom sub. The bottom sub may comprise a connector for coupling to a shunt tube or the like. The bottom sub may comprise a channel for communicating with the conduit.

The apparatus may comprise a connection arrangement for coupling the apparatus to a tubular string.

The connection arrangement may comprise a connector for coupling the downhole tool to an uphole component of the tubular string. In some embodiments, the connector for coupling the tool to an uphole component of the tubular string may be integral to the second member. In particular embodiments, the connector for coupling the tool to an uphole component of the tubular string may comprise a separate component, in particular but not exclusively a top sub or the like.

In particular embodiments, the uphole connector comprises a threaded box connector.

The connection arrangement may comprise a connector for coupling the tool to a downhole component of the tubular string. In some embodiments, the connector for coupling the tool to a downhole component of the tubular string may be integral to the second member. In particular embodiments, the connector for coupling the tool to a downhole component of the tubular string may comprise a separate component, in particular but not exclusively a bottom sub or the like.

At least one of the uphole connector and the downhole connector may comprise a threaded connector or the like. At least one of the uphole connector and the downhole connector may comprise a threaded box connector. At least one of the uphole connector and the downhole connector may comprise a threaded pin connector.

In particular embodiments, the downhole connector comprises a threaded pin connector.

The apparatus may be provided in combination with, form part of, and/or may be coupled to, a completion system.

The completion system may comprise a screen, such as a sand screen.

The apparatus may comprise, may be coupled to, or may be operatively associated with, the screen.

The apparatus comprise a plurality of screen portion.

According to a second aspect, there is provided a method for performing a borehole packing operation, comprising:

activating an apparatus according to the first aspect from a first configuration to a second configuration by urging a seal element of the apparatus to a radially extended position using an activation arrangement operatively associated with the seal member, the seal member comprising a swellable member configured to swell on exposure to a selected reactant and thereby reconfigure the apparatus from the second configuration to a third configuration; and directing a borehole packing material through the conduit.

The method may comprise the step of disposing the apparatus in the borehole.

According to a third aspect, there is provided a packer apparatus for use in a borehole packing operation, the apparatus comprising: a body; a seal member disposed on the body; an activation arrangement operatively associated with the seal member, the activation arrangement configured to engage the seal member to urge the seal element to a radially extended position relative to the body and thereby reconfigure the apparatus from a first configuration to a second configuration; a conduit configured to transport a borehole packing material through the apparatus; and a fluid communication arrangement for providing lateral fluid communication through the apparatus, the fluid communication arrangement disposed between a first end and a second end of the apparatus.

The fluid communication arrangement may be disposed between the first end of the apparatus and the seal member of the apparatus. The fluid communication arrangement the second end of the apparatus and the seal member of the apparatus.

In use, the apparatus may be run into a borehole as part of a downhole completion assembly. On reaching the desired location, the apparatus may be activated to urge the seal member into sealing engagement with the borehole, and thereby isolate an annular region between the apparatus and the borehole.

Embodiments of the present invention—for example but not exclusively by virtue of the location of the fluid communication arrangement inboard of the ends of the apparatus permits effective borehole isolation while also increasing the proportion of the borehole which can be packed—or in other words reducing the proportion of the borehole which, due to the length of the packer apparatus, is typically not packed or which suffers from poor quality packing for the reasons previously described. Embodiments of the present invention thus reduce the possibility of screen erosion which may otherwise result in screen failure. Moreover, by providing a shorter packer apparatus, embodiments of the present invention may also permit isolation of shorter borehole intervals, increasing the operators ability to control access from and/or a given formation zone.

In particular embodiments, the conduit may be disposed or formed within the body of the apparatus. The body may comprise an inner member and an outer member. The conduit may be disposed or formed between the inner member and the outer member.

In particular embodiments, the inner member of the body and the outer member of the body may comprise separate members. However, in other embodiments, the inner member and the outer member may be integrally formed or otherwise comprise a unitary construction.

The inner member may comprise a throughbore defining an axial flow passage through the apparatus. The conduit may be isolated from the throughbore.

The throughbore may be configured to permit downhole tooling and equipment through the apparatus—and in due course oil and/or gas production fluid flows to surface—while the conduit permits the borehole packing material, such as gravel slurry, to be communicated through the apparatus.

The conduit may be annular. Alternatively or additionally, the conduit may be tubular.

A central longitudinal axis of the conduit may be offset relative to a central longitudinal axis of the apparatus. Offsetting the central longitudinal axis of the conduit relative to the central longitudinal axis of the apparatus beneficially provides sufficient capacity to transport the required volumes of packing material without increasing the overall outer diameter of the apparatus.

The apparatus may comprise a leak-off conduit.

The apparatus may comprise a pack conduit.

The apparatus may comprise one or more flow line, such as a transport tube or shunt tube, shunt conduit or the like, for communicating the borehole packing material through the apparatus.

The fluid communication arrangement may be configured to provide fluid communication to the throughbore of the apparatus. The fluid communication arrangement may be configured to provide fluid communication from the annulus to the throughbore of the apparatus.

The fluid communication arrangement may comprise one or more bore or perforations in the body, in particular embodiments a plurality of bores of perforations in the body.

The fluid communication arrangement may comprise a screen portion, such as screen.

In use, the fluid communication arrangement beneficially permits bore packing material used in a gravel pack operation to dehydrate by permitting the carrier fluid to pass into the throughbore of the apparatus for return to surface, increasing the proportion of the borehole which can be packed—or in other words reducing the proportion of the borehole which, due to the length of the packer apparatus, is typically not packed or which suffers from poor quality packing for the reasons previously described reducing the possibility of screen erosion which may otherwise result in screen failure.

The seal member may be configured to define a cup seal in the second, radially extended, configuration of the apparatus.

The seal member may comprise a uni-drectional seal member.

The seal member may comprise a cup seal member. In use, the apparatus may be configured so that a pressure differential across the seal member urges the seal member towards the extended configuration.

The seal member may comprise a proximal end and a distal end. The proximal end of the seal member may be fixed to the body. The distal end may be configured to be urged radially outwards by the activation arrangement.

The seal member may have a sealing surface for forming a seal, in use, with borehole.

The sealing surface may be a portion of the outside surface of the seal member.

The sealing surface may include a profiled portion.

The profile may comprise a corrugated or ribbed profile. Beneficially, a profiled surface may provide a greater available area for contact between the seal member and the borehole. Moreover, a profiled surface may be better suited to sealing with non-uniform surfaces which may be found in open hole applications.

The apparatus may comprise a plurality of the seal members. In particular embodiments, the apparatus comprises two seal members. The seal members may be disposed on the body in opposing or back-to-back orientation relative to each other.

The apparatus may comprise a seal back-up arrangement.

The seal back-up arrangement may be configured to support the seal member in the radially extended position. In use, the seal back-up may support the seal member and prevent or reduce the likelihood of extrusion of the seal member which may otherwise detrimentally affect the seal provided between the seal member and the borehole.

The seal back-up arrangement may comprise a back-up assembly operatively associated with an uphole end of the seal member. The seal back-up arrangement may comprise a back-up assembly operatively associated with a downhole end portion of the seal member.

The back-up assembly or in embodiments comprising a plurality of back-up assemblies at least one of the back-up assemblies may comprise an inner back-up layer having a first portion and a second portion which pivots radially outwards with movement of the seal member. The first portion may be fixed relative to the body. For example, the first portion may be secured to a collar. The second portion may comprise petals.

The activation arrangement may be configured to transition the apparatus from the first configuration to the second configuration.

The activation arrangement may be mechanically activated. The activation arrangement may be spring actuated. Alternatively or additionally, the activation arrangement may be fluid activated.

In use, the activation arrangement may apply a setting force to the seal member to move the seal member from the first configuration to the second configuration. The seal member may form a contact seal with the borehole wall in the second configuration.

The seal setting apparatus may engage a portion of the inside surface of the seal member.

The activation arrangement may comprise at least one elongate element.

The activation arrangement may comprise a plurality of elongate elements.

The elongate element may have a first end and a second end.

The first end of the/each elongate element may be fixed relative to the mandrel.

In the first, or run-in, configuration, the/each elongate element may be arranged substantially axially with the packer mandrel.

Using a plurality of axially extending elongate elements in contact and applying a setting force to the inside surface of a cup seal member, permits each elongate element and the seal member to conform and seal in non-round holes, as each elongate element can apply pressure substantially independently of neighbouring elongate elements sufficient to achieve engagement between a portion of the seal member and a portion of the conduit wall. This arrangement also permits the packer to conform to changes in the geometry over the hole over time. This is advantageous because over time the shape of the hole may change from round to non-round.

The elongate element, or in embodiments comprising a plurality of elongate elements at least one elongate element, may comprise a spring, such as a leaf spring.

The apparatus may be configured to be locked in the first configuration.

The apparatus may comprise a lock arrangement for locking the apparatus in the first configuration.

The lock arrangement may comprise a dog. The apparatus may be configured so that the activation piston is prevented from axial movement relative to the body by the dog, when the apparatus defines the first configuration.

In particular embodiments, the lock arrangement comprises a plurality of dogs.

The dogs may be circumferentially arranged and/or spaced.

The lock arrangement may comprise a lock sleeve.

The apparatus may be configured so that the activation piston is prevented from axial movement relative to the body by the lock sleeve, when the apparatus defines the first configuration.

The apparatus may be configured so that the dog is prevented from radially inwards movement relative by the lock sleeve, when the apparatus defines the first configuration.

The lock sleeve may comprise a shifting profile for engagement with a shifting tool. In use, the shifting profile may be engaged by a shifting tool to shift the lock sleeve axially relative to the body, this permitting the dog to move radially inwards to release the activation piston for axial movement relative to the body.

The lock arrangement may comprise a retainer. The retainer may be configured to retain the lock piston relative to the body. The retainer may be configured to shear or break in response to a force, for example but not exclusively a fluid pressure force acting on the lock piston, exceeding a selected force threshold.

A rotational lock may be provided. Beneficially, the provision of a rotational lock assists in maintaining rotational alignment between the components of the apparatus. The rotational lock may be disposed between the first member and the second member. The rotational lock may be configured to prevent or limit relative rotation between the first member and the second member. The rotational lock may be configured to permit axial movement of the first member and the second. The rotational lock may be of any suitable form and construction. In particular embodiments, the rotational lock may comprise a pin or screw configured to engage a groove. The screw may be provided in the second member and the groove may be provided in the first member, or vice versa.

The apparatus may comprise a top sub.

The apparatus may comprise a bottom sub.

The apparatus may comprise a connection arrangement for coupling the apparatus to a tubular string.

The connection arrangement may comprise a connector for coupling the downhole tool to an uphole component of the tubular string. In some embodiments, the connector for coupling the tool to an uphole component of the tubular string may be integral to the second member. In particular embodiments, the connector for coupling the tool to an uphole component of the tubular string may comprise a separate component, in particular but not exclusively a top sub or the like.

In particular embodiments, the uphole connector comprises a threaded box connector.

The connection arrangement may comprise a connector for coupling the tool to a downhole component of the tubular string. In some embodiments, the connector for coupling the tool to a downhole component of the tubular string may be integral to the second member. In particular embodiments, the connector for coupling the tool to a downhole component of the tubular string may comprise a separate component, in particular but not exclusively a bottom sub or the like.

At least one of the uphole connector and the downhole connector may comprise a threaded connector or the like. At least one of the uphole connector and the downhole connector may comprise a threaded box connector. At least one of the uphole connector and the downhole connector may comprise a threaded pin connector.

In particular embodiments, the downhole connector comprises a threaded pin connector.

The apparatus may be provided in combination with, form part of, and/or may be coupled to, a completion system.

The completion system may comprise a screen, such as a sand screen.

The apparatus may comprise, may be coupled to, or may be operatively associated with, the screen.

The apparatus comprise a plurality of screen portion.

According to a fourth aspect, there is provided a method for performing a borehole packing operation, comprising: activating an apparatus according to the third aspect from a first configuration to a second configuration by urging a seal element of the apparatus to a radially extended position using an activation arrangement operatively associated with the seal member; and directing a borehole packing material through the conduit.

The method may comprise the step of disposing the apparatus in the borehole.

It will be understood that features defined above or below may be utilised in isolation or in combination with any other defined feature.

BRIEF DESCRIPTION OF THE DRAWINGS

These and other aspects will now be described with reference to the accompanying drawings, of which.

DETAILED DESCRIPTION

Referring first to FIGS. 1 to 6 of the accompanying drawings, there is shown an apparatus 10 for use in a well borehole packing operation, such as a multi-zone gravel packing operation.

Figure 1:
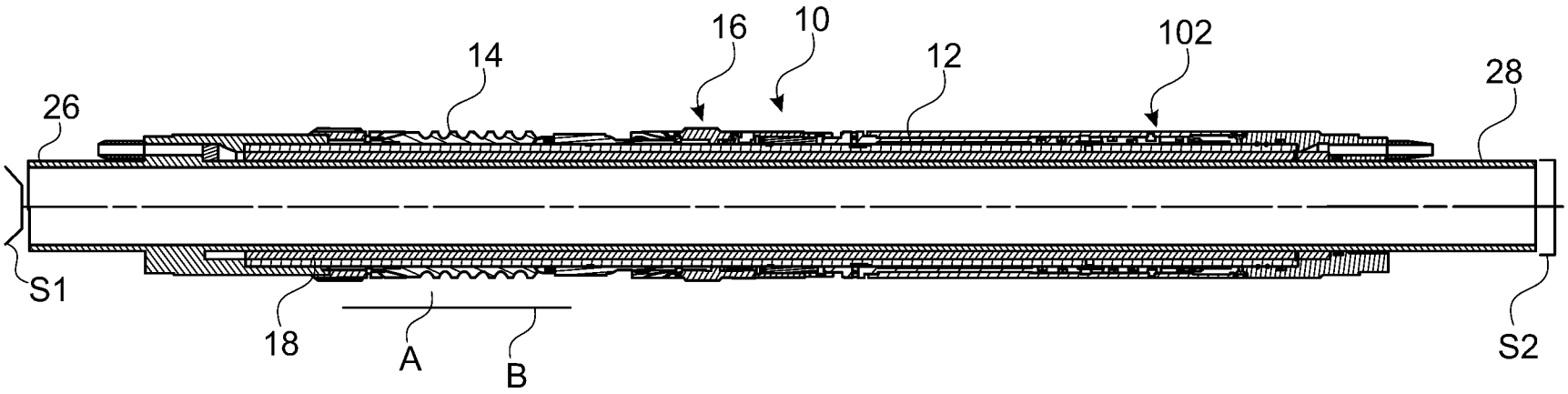
FIG. 1 shows an apparatus for use in a well borehole packing operation.
Figure 2:
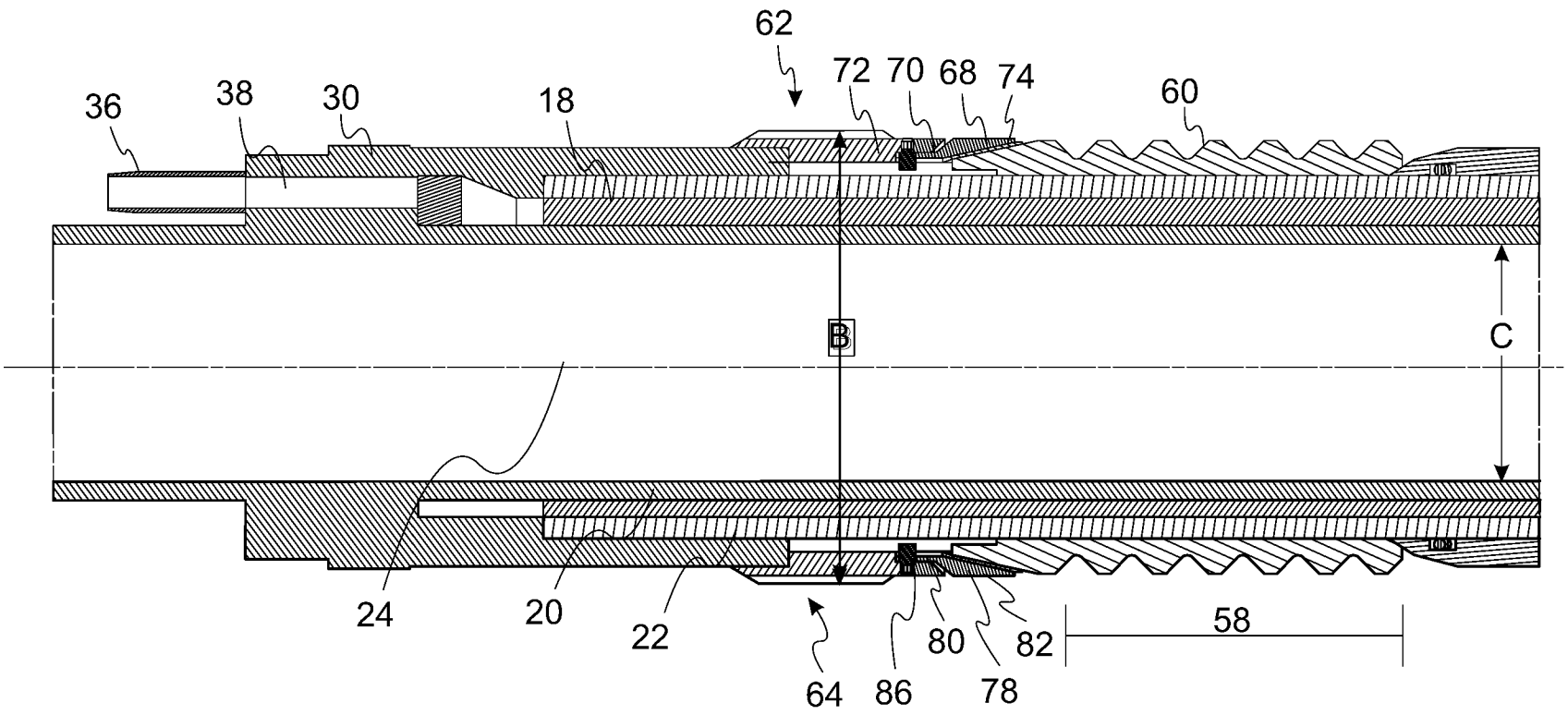
FIG. 2 shows an enlarged view of a first portion of the apparatus shown in FIG. 1.
Figure 3:
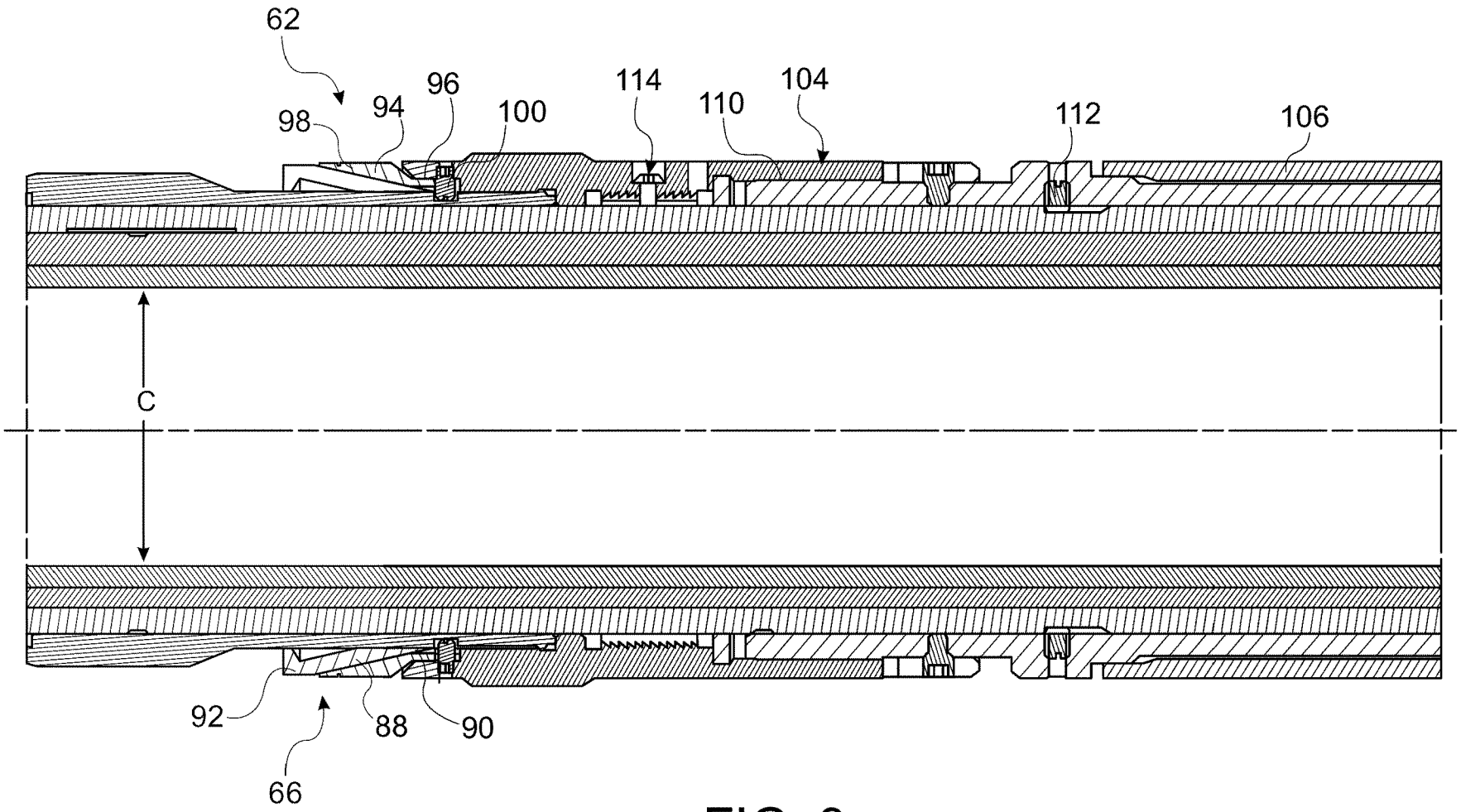
FIG. 3 shows an enlarged view of a second portion of the apparatus shown in FIG. 1.
Figure 4:
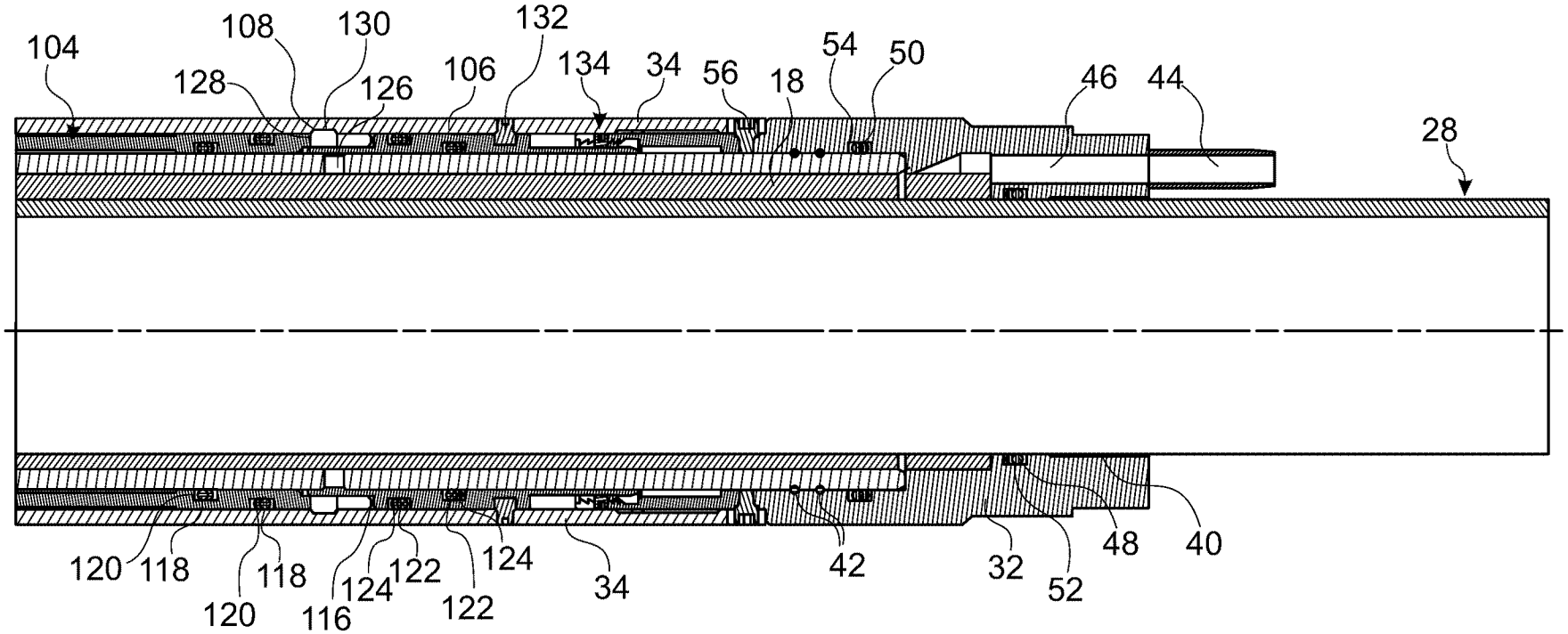
FIG. 4 shows an enlarged view of a third portion of the apparatus shown in FIG. 1.
Figure 5:
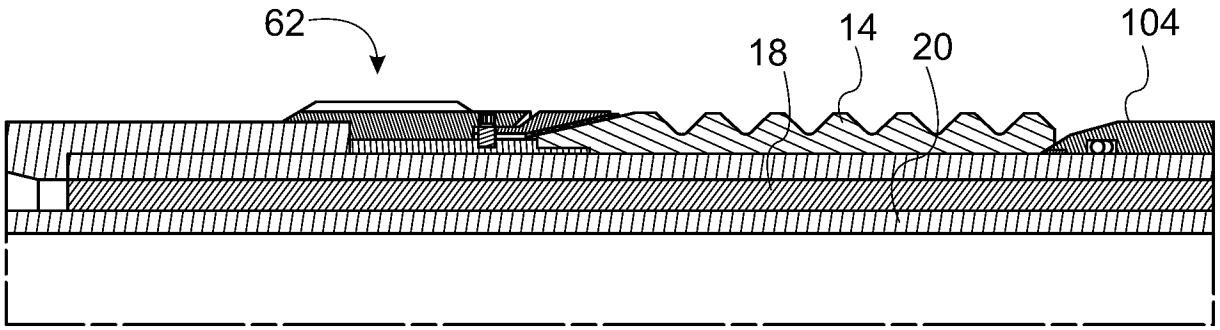
FIG. 5 shows an enlarged view of part of the apparatus, showing the seal member in the first configuration.
Figure 6:
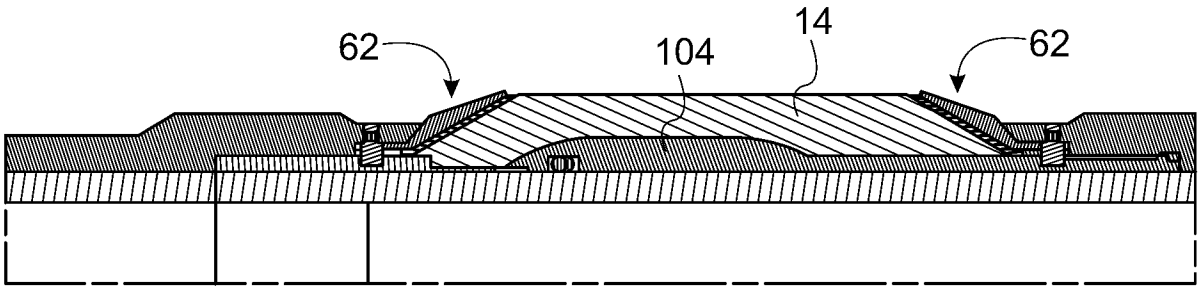
FIG. 6 shows an enlarged view of the part of the apparatus shown in FIG. 5, showing the seal member in the second configuration.

As shown in FIG. 1, the apparatus 10 takes the form of a downhole packer and comprises a body 12 and an annular seal member 14.

In use, the apparatus 10 is run into a borehole B as part of a downhole completion assembly. On reaching the desired location, the apparatus 10 is activated to urge the seal member 14 into sealing engagement with the borehole B, and thereby isolate an annular region A between the apparatus 10 and the borehole B. The seal member 14 is activatable between a first configuration in which the seal member 14 defines a first, retracted, configuration relative to the body 12 and a second configuration in which the seal member 14 defines a radially extended configuration relative to the body 12 by an activation arrangement 16, which is described further below.

In the illustrated embodiment, the seal member 14 comprises a swelling elastomer and is activatable between the second configuration and a third configuration on exposure to a selected reactant. In the illustrated embodiment, the seal member 14 is swellable in response to well fluid.

A conduit 18 is disposed within the body 12. The conduit 18 is configured to transport a borehole packing material, such as gravel slurry, through the apparatus 10. Embodiments of the apparatus 10 thus permit borehole isolation, for example in order to provide selective zonal isolation, using the seal member 14 while permitting borehole packing material to bypass the apparatus 10 and thereby facilitate continuous communication of packing material across a plurality of formation zones to perform multi-zone borehole packing operations.

As shown in the accompanying drawings, the conduit 18 is offset from a central longitudinal axis of the apparatus 10. Beneficially, this permits the conduit 18 to provide for the transport of the borehole packing material without increasing the outer dimensions of the apparatus 10 and/or permits the conduit 18 to readily align with the offset of an adjacent component of the completion assembly e.g. a sand screen to which the apparatus coupled in use.

Referring now also to FIGS. 2 to 6 of the accompanying drawings, the body 12 comprises an inner body portion 20 and an outer body portion 22, the conduit 18 formed in the annular region defined between the inner body portion 20 and the outer body portion 22.

The inner body portion 20 is tubular in construction, defining an axial throughbore 24 of the apparatus 10. In use, the axial throughbore 24 facilitates passage of production fluid to surface and/or passage of downhole tooling through the apparatus 10.

An uphole end (left end as shown in FIG. 1) of the inner body portion 20 forms a connector 26 in the form of a threaded box connector for coupling the apparatus 10 to an uphole component S1 of the completion assembly. In the illustrated embodiment, the component S1 takes the form of a sand screen joint.

A downhole end (right end as shown in FIG. 1) forms a connector 28 in the form of a threaded pin connector for coupling the apparatus 10 to a downhole component S2 of the completion assembly. In the illustrated embodiment, the component S2 takes the form of a sand screen joint.

It will be recognised that while in the illustrated embodiment the connector 26 takes the form of a box connector and the connector 28 takes the form of a pin connector, the connector 26 may alternatively comprise a pin connector or other suitable connector and the connector 28 may alternatively comprise a box connector or other suitable connector. In the illustrated embodiment, the connectors 26 and 28 are integrally formed with the inner body portion 20. However, one or both of the connectors 26, 28 may alternatively be provided on a separate sub.

The outer body portion 22 is tubular in construction and the seal member 14 and the activation arrangement 16 are disposed around the outer body portion 22.

The apparatus 10 further comprises a top sub 30, a bottom sub 32 and an outer housing 34.

The top sub 30 is configured to be coupled to an uphole end portion of the body 12 and comprises a connector 36 and channel 38 for communicating with the conduit 18. The top sub 30 is threaded and sealed to the body 12.

The bottom sub 32 is disposed on a downhole end portion of the body 12 at 40, the bottom sub 32 slid onto the body 12 and retained by lock wires 42. The bottom sub 32 comprises a connector 44 and channel 46 for communicating with the conduit 18. Seals 48, 50 are provided in respective grooves 52, 54 provided in the bottom sub 32 to prevent fluid leakage between the bottom sub 32 and the body 12. An uphole end portion of the bottom sub 32 provides mounting for the outer housing 34, the outer housing 34 secured to the bottom sub 32 by one or more fasteners 56, which in the illustrated embodiment take the form of grub screws.

It will be recognised that the top sub channel 38, the bottom sub channel 42 and the conduit 18 provide a continuous passage, permitting transport of the gravel slurry through the apparatus 10 while permitting zonal isolation of the borehole B using the seal member 14.

As described above, the seal member 14 is disposed around the body 12.

In the illustrated embodiment, the seal member 14 has a profiled portion 58. The profiled portion 58 defines a corrugated or ribbed profile 60. Beneficially, the profiled portion 58 assists in conforming the seal member 14 to the borehole B when the apparatus 10 is activated by the activation arrangement 16. However, it will be understood that some embodiments of the apparatus 10 do not comprise a profiled portion.

A seal back-up arrangement 62 is provided, the seal back-up arrangement 62 configured to support the seal member 14 in the radially extended position and prevent or reduce the likelihood of extrusion of the seal member 14 which may otherwise detrimentally affect the seal provided between the seal member 14 and the borehole B.

In the illustrated embodiment, the seal back-up arrangement 62 comprises a back-up assembly 64 operatively associated with an uphole end of the seal member 14 and a back-up assembly 66 operatively associated with a downhole end portion of the seal member 14.

The back-up assembly 64 comprises an inner back-up layer 68 having a first portion 70 secured to a collar 72 and a second portion 74 which pivots radially outwards with movement of the seal member 14. The second portion 74 comprises petals.

The back-up assembly 64 further comprises an outer back-up layer 78 having a first portion 80 secured to the collar 72 and a second portion 82 which pivots radially outwards with movement of the seal member 14. The second portion 82 comprises petals which circumferentially overlap with the petals of the inner back-up layer 68 and assist in preventing extrusion of the seal element 14.

Both the inner back-up layer 68 and the outer back-up layer 78 are secured to the collar 72 by fasteners 86, which in the illustrated embodiment comprise grub screws (two of which are shown in FIG. 1).

The back-up assembly 66 comprises an inner back-up layer 88 having a first portion 90 and a second portion 92 which pivots radially outwards with movement of the seal member 14. The second portion 92 comprises petals.

The back-up assembly 66 further comprises an outer back-up layer 94 having a first portion 96 and a second portion 98 which pivots radially outwards relative to the first portion 96 with movement of the seal member 14. The second portion 98 comprises petals which circumferentially overlap with the petals of the inner back-up layer 88 and assist in preventing extrusion of the seal element 14.

Both the inner back-up layer 88 and the outer back-up layer 94 are secured by fasteners, which in the illustrated embodiment comprise grub screws 100 (two of which are shown).

As described above, the apparatus 10 comprises an activation arrangement 16 for transitioning the apparatus 10 from the first configuration to the second configuration. The apparatus 10 further comprises a lock arrangement 102 for retaining the apparatus 10 in the first configuration until it is required to activate the apparatus 10.

In the illustrated embodiment, the activation arrangement 16 comprises an activation piston 104 and the lock arrangement 102 comprises a lock piston 106 operatively associated with one or more dog 108 (two dogs 108 are shown).

The activation piston 104 is disposed around an outer surface of the body 12. In the illustrated embodiment, the activation piston 104 is modular in construction, although it will be understood that the activation piston 104 may alternatively comprise a unitary construction.

The activation piston 104 is coupled to the body 12 by thread connection 110.

One or more retainer 112—in the illustrated embodiment in the form of shear pins—retain the activation piston 104 relative to the body 12 until the apparatus 10 is activated.

In use, the activation piston 104 is axially moveable relative to the body 12, axial movement of the activation piston 104 towards the seal member 14 urging the seal member 14 radially outwards; transitioning the apparatus 10 from the first configuration to the second configuration. A ratchet 114 prevents reverse movement of the activation piston 104 which would otherwise de-activate the apparatus 10.

As shown, a downhole end portion of the activation piston 104 is disposed on an uphole end portion of the lock piston 106. A chamber 116 is formed between the activation piston 104 and the lock piston 106. The chamber 116 is isolated by seals 118 disposed in grooves 120 in the activation piston 104 and seals 122 disposed in grooves 124 formed in the lock piston 106. The chamber 116 communicates with the conduit 18 via one or more port 126 (two ports 126 are shown in FIG. 1).

In the illustrated embodiment, the dogs 108 of the lock arrangement 102 are disposed through bores 128 in the activation piston 104 and engage a recess 130 in the outer housing 34, the inter-engagement between the activation piston 104, the dogs 108 and the recess 130 preventing axial movement of the activation piston 104.

The lock piston 106 is disposed around the body 12 and, in the first configuration of the apparatus 10, is retained to the outer housing 34 by one or more retainer—which in the illustrated embodiment take the form of a shear pin 132 (two of which are shown).

As described above, in operation the apparatus 10 is run into the borehole B as part of a completion assembly.

On reaching the target location in the borehole B, fluid pressure is applied, via ports 126, to chamber 116 which in turn applies a pressure force on the activation piston 104 (in an uphole direction) and the lock piston 106 (in a downhole direction). When the pressure force acting on the lock piston 106 exceeds a threshold value the shear pins 132 shear permitting the lock piston 106 to move axially relative to the body 12 in a downhole direction (to the right as shown in the accompanying drawings). A ratchet 134 prevents reverse movement of the lock piston 106. Axial movement of the lock piston 106 relative to the body 12 de-supports the dogs 108 which are permitted to move radially inwards. As the dogs 108 are no longer axially restrained by the recess 130, the activation piston 104 is freed to move axially with respect to the body 12 in an uphole direction (to the left as shown in the accompanying drawings) so as to urge the seal member 14 radially outwardly; thereby transitioning the apparatus 10 from the first configuration to the second configuration. The profiled portion of the seal member 14 ensures a compliant seal is obtained between the seal member 14 and the borehole B, even in instances where the borehole B is irregular or non-circular. The seal member 14—on exposure to the well fluid—will swell into sealing (where not already achieved) or enhanced sealing engagement with the borehole B, moving from the configuration shown in FIG. 5 to the configuration shown in FIG. 6.

Embodiments of the present invention—for example but not exclusively by virtue of the combination of activation arrangement and swellable seal member—permit the length of the apparatus 10 to be reduced compared to conventional packer apparatus. Pre expansion of the seal member 14 using the activation arrangement for example reduces the time to form a seal due to swelling. It also retains material strength by reducing the expansion required due to swelling alone. This permits effective borehole isolation while increasing the proportion of the borehole which can be packed—or in other words reducing the proportion of the borehole which, due to the length of the packer apparatus, is typically not packed or which suffers from poor quality packing for the reasons previously described. Embodiments of the apparatus thus reduce the possibility of screen erosion which may otherwise result in screen failure. Moreover, by providing a shorter packer apparatus, embodiments of the apparatus may also permit isolation of shorter borehole intervals, increasing the operators ability to control access from and/or a given formation zone.

Figure 7:
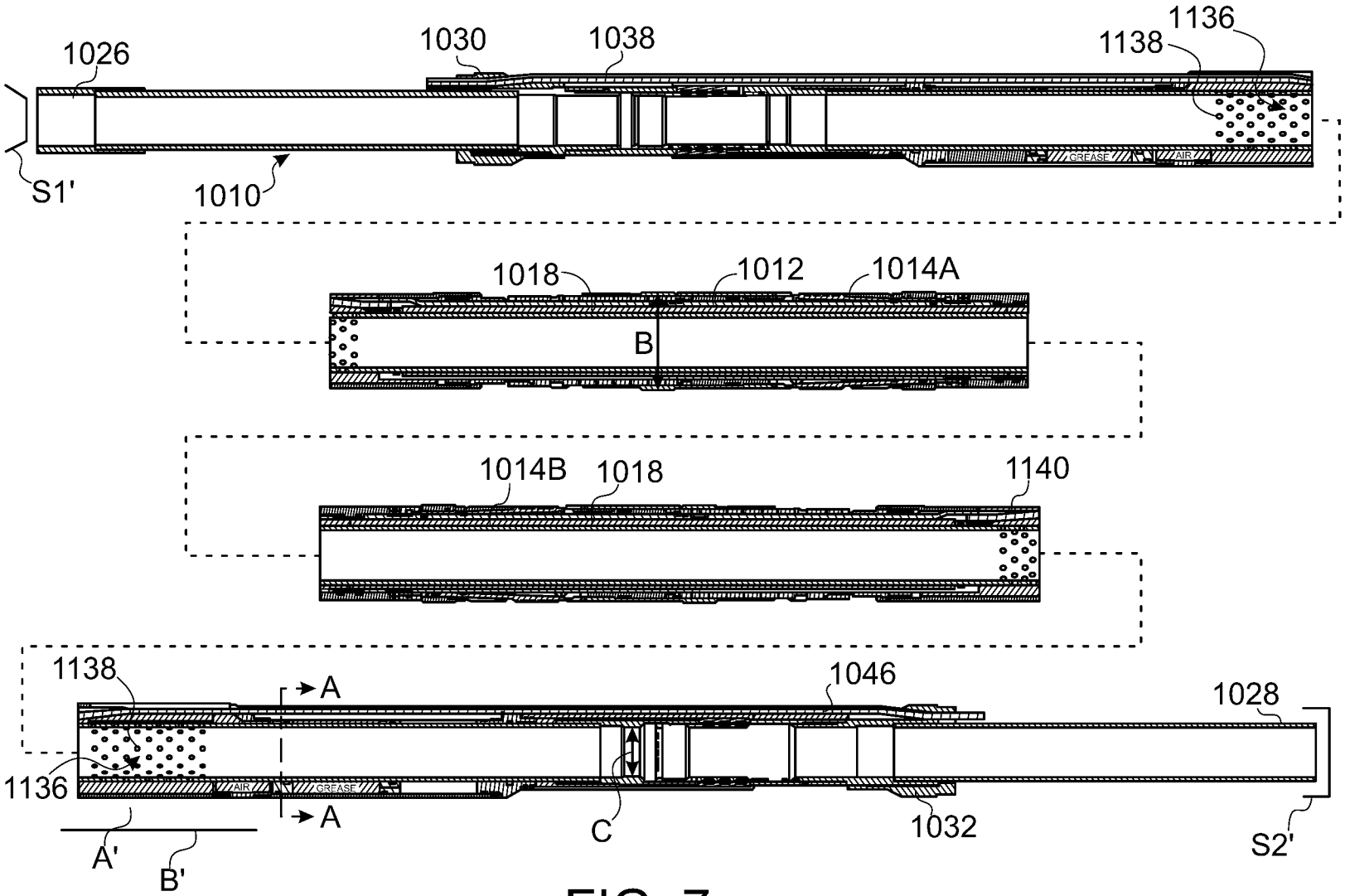
FIG. 7 shows another apparatus for use in a well borehole packing operation.
Figure 8:
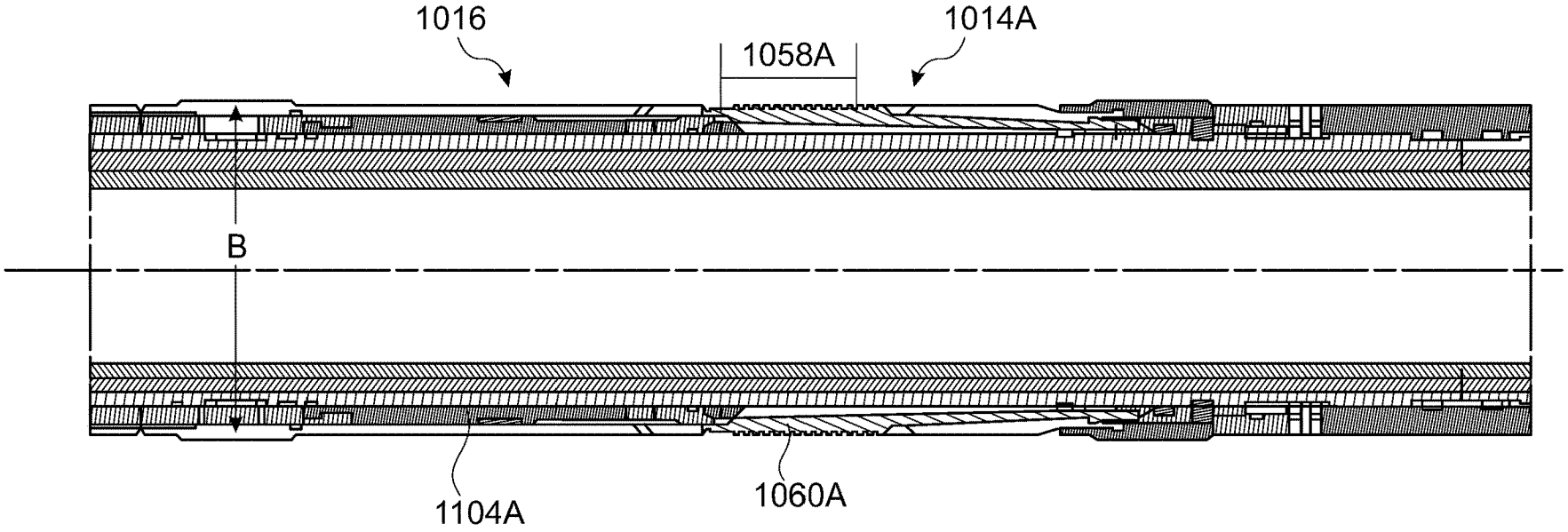
FIG. 8 shows an enlarged view of a first portion of the apparatus shown in FIG. 7.
Figure 9:
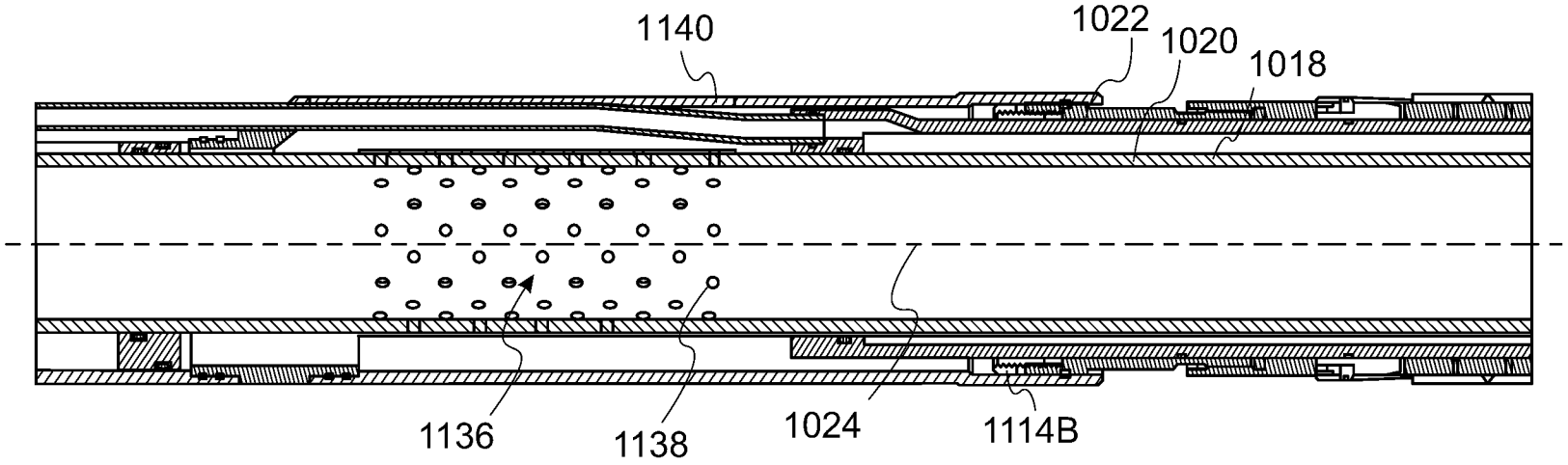
FIG. 9 shows an enlarged view of a second portion of the apparatus shown in FIG. 7.
Figure 10:
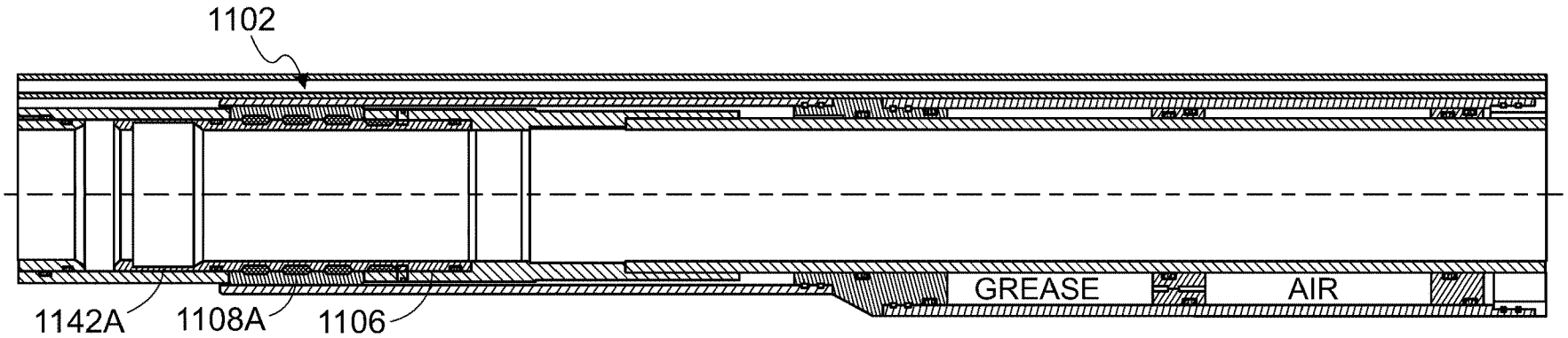
FIG. 10 shows an enlarged view of a third portion of the apparatus shown in FIG. 7.
Figure 11:
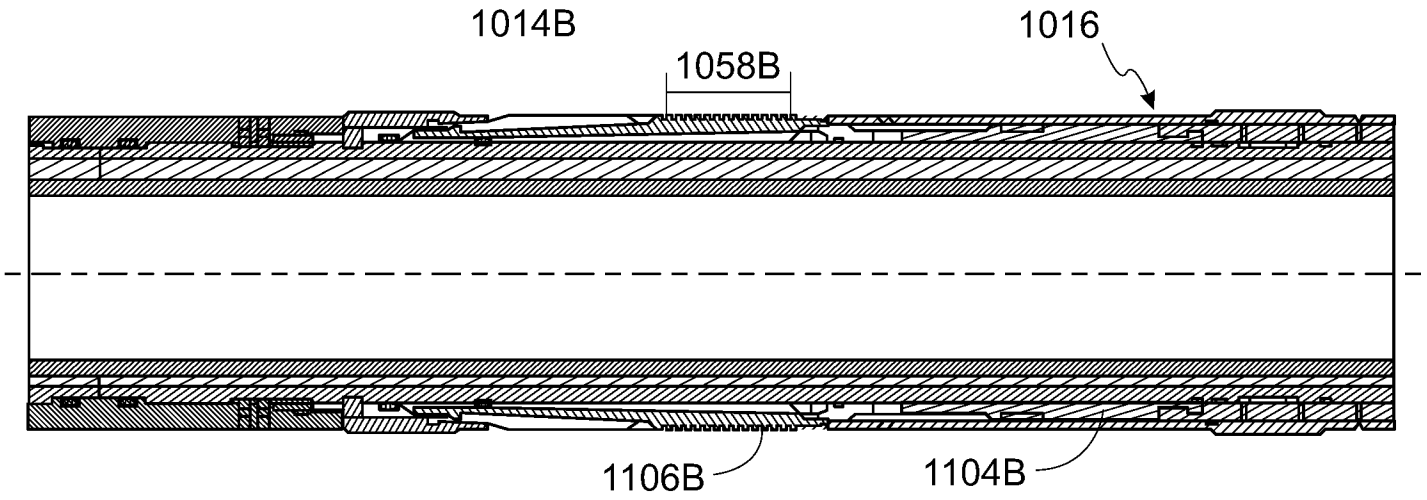
FIG. 11 shows an enlarged view of a fourth portion of the apparatus shown in FIG. 7.
Figure 12:
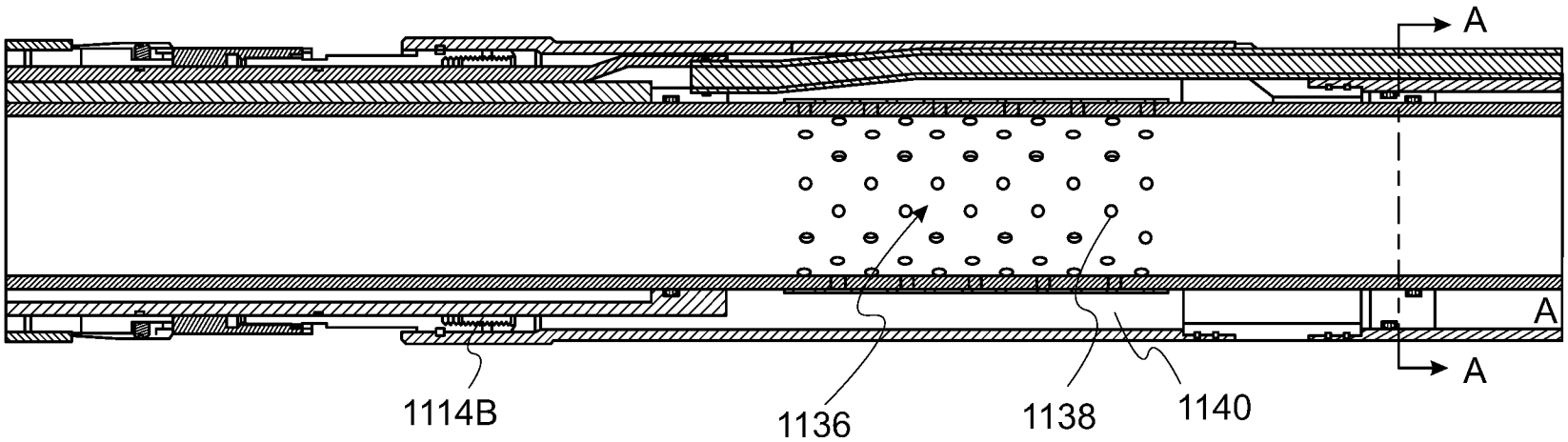
FIG. 12 shows an enlarged view of a fifth portion of the apparatus shown in FIG. 7.
Figure 13:
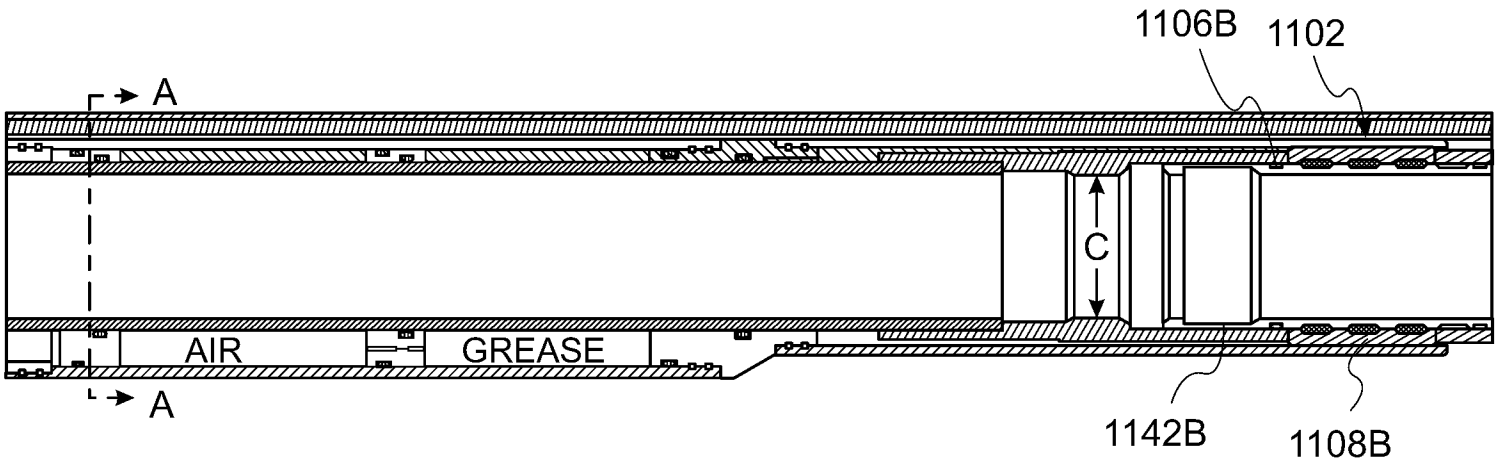
FIG. 13 shows an enlarged view of a sixth portion of the apparatus shown in FIG. 7.

Referring now to FIGS. 7 to 15 of the accompanying drawings, there is shown an apparatus 1010 for use in a well borehole packing operation, such as a multi-zone gravel packing operation. As shown in FIG. 7, the apparatus 1010 takes the form of a downhole packer and comprises a body 1012 and two annular seal members 1014A, 1014B.

In use, the apparatus 1010 is run into a borehole B' as part of a downhole completion assembly. On reaching the desired location, the apparatus 1010 is activated to urge the seal members 1014A, 1014B into sealing engagement with the borehole B', and thereby isolate an annular region A' between the apparatus 1010 and the borehole B'. The seal members 1014A, 1014B are activatable between a first configuration in which the seal members 1014 define a first, retracted, configuration relative to the body 1012 and a second configuration in which the seal members 1014A, 1014B defines a radially extended configuration relative to the body 1012 by an activation arrangement 1016, which is described further below.

In the illustrated embodiment, the apparatus 1010 comprise two seal members 1014A, 1014B which are disposed in opposing or back-to-back orientation relative to each other and which each take the form of a cup seal member as will be described further below.

A conduit 1018 is disposed within the body 1012. The conduit 1018 is configured to transport a borehole packing material, such as gravel slurry, through the apparatus 1010. Embodiments of the apparatus 1010 thus permit borehole isolation, for example in order to provide selective zonal isolation, using the seal members 1014 while permitting borehole packing material to bypass the apparatus 1010 and thereby facilitate continuous communication of packing material across a plurality of formation zones to perform multi-zone borehole packing operations.

Figure 14:
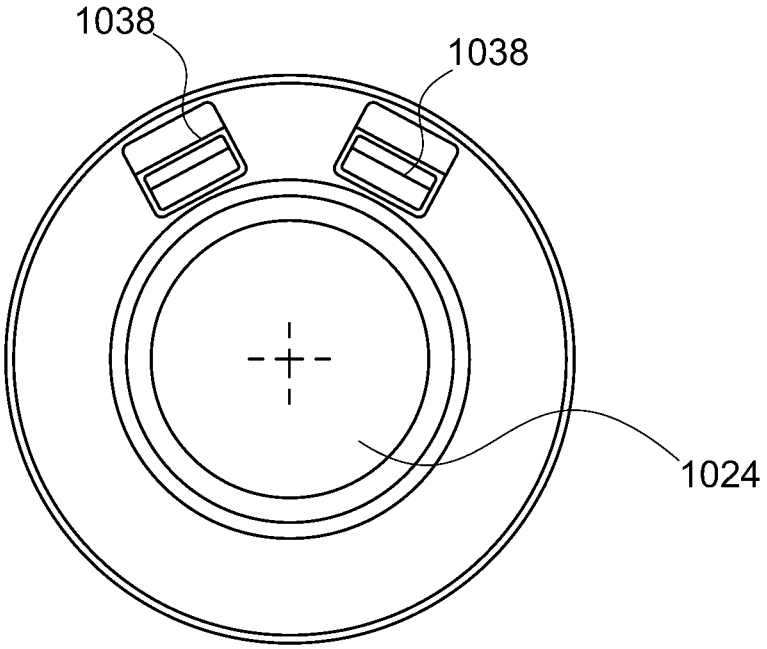
FIG. 14 shows an end view of the apparatus shown in FIG. 7.
Figure 15:
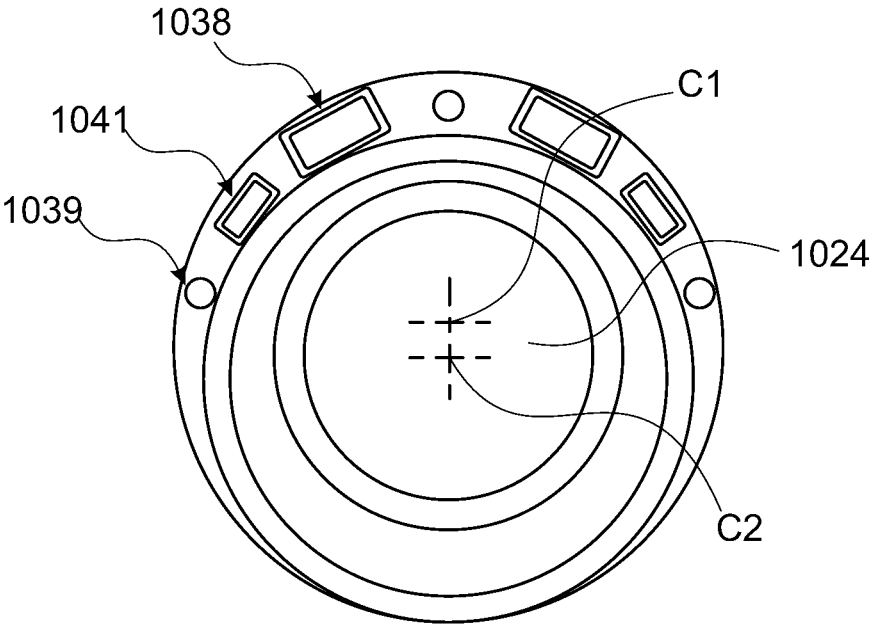
FIG. 15 shows cross section A-A shown in FIG. 7.

Referring now also to FIGS. 8 to 13 of the accompanying drawings, which show enlarged view of portions of the apparatus 1010, and to FIGS. 14 and 15, which show an end view and cross-sectional view A-A respectively, the body 1012 comprises an inner body portion 1020 and an outer body portion 1022, the conduit 1018 formed in the annular region defined between the inner body portion 1020 and the outer body portion 1022.

The inner body portion 1020 is tubular in construction, defining an axial throughbore 1024 of the apparatus 10. In use, the axial throughbore 1024 facilitates passage of downhole tooling through the apparatus 1010, including a setting tool operatively associated with the apparatus as will be described below and in due course passage of production fluid to surface.

As shown in the accompanying drawings, most clearly in FIG. 15, in the illustrated embodiment the conduit 1018 is offset from a central longitudinal axis of the apparatus 1010, a central longitudinal axis C1 of the conduit 1018 being spaced relative to a central longitudinal axis C2 of the apparatus 1010. Offsetting the central longitudinal axis C1 of the conduit 1018 relative to the central longitudinal axis C2 of the apparatus 100 beneficially provides sufficient capacity to transport the required volumes of packing material without increasing the overall outer diameter of the apparatus 1010. Beneficially, this permits the conduit 1018 to provide for the transport of the borehole packing material without increasing the outer dimensions of the apparatus 1010, and facilitates space within the apparatus 1010 for transport tubing 1038, leak off tubing 1039 and pack tubing 1041.

As shown in FIG. 7, an uphole end (left end as shown) of the inner body portion 1020 forms a connector 1026 in the form of a threaded box connector for coupling the apparatus 1010 to an uphole component S1' of the completion assembly. In the illustrated embodiment, the component S1' takes the form of a sand screen joint.

A downhole end (right end as shown in FIG. 7) forms a connector 1028 in the form of a threaded pin connector for coupling the apparatus 1010 to a downhole component S2' of the completion assembly. In the illustrated embodiment, the component S2' takes the form of a sand screen joint. The apparatus 1010 may thus be disposed axially between adjacent sand screen joints in the completion system.

It will be recognised that while in the illustrated embodiment the connector 1026 takes the form of a box connector and the connector 1028 takes the form of a pin connector, the connector 1026 may alternatively comprise a pin connector or other suitable connector and the connector 1028 may alternatively comprise a box connector or other suitable connector. In the illustrated embodiment, the inner body portion 1020 is modular in construction, the connectors 1026 and 1028 provided on separate subs. However, one or both of the connectors 1026, 1028 may alternatively be integrally formed with the inner body portion 1020.

The apparatus 1010 comprises a fluid communication arrangement 1136 for providing lateral fluid communication between the annulus A' and the throughbore of the apparatus 1010. In the illustrated embodiment, the fluid communication arrangement 1136 comprises one or more bores or perforations 1138. The bores or perforations 1138 are provided in the inner body portion 1020. A screen portion 1140, such as a sand screen, is provided, the screen portion 1140 preventing or mitigating the ingress of particulate matter, such as sand or the like and/or proppant used in a gravel pack operation, through the bores or perforations 1138 while permitting lateral (i.e. radially inwards) flow of fluid, such as carrier fluid.

It can be seen that the fluid communication arrangement 1136 is disposed between ends of the apparatus 1010 i.e., between a first, uphole, end of the apparatus 1010 and a second, downhole, end of the apparatus 1010. More particularly, the fluid communication arrangement 1136 is disposed between the ends of the apparatus 1010 and the seal members 1014A, 1014B.

In use, the fluid communication arrangement 1136 permits bore packing material used in a gravel pack operation to dehydrate by permitting the carrier fluid to pass into the throughbore of the apparatus 1010 for return to surface; this occurring inboard of the completion system components S1', S2' e.g. sand screen joints.

Embodiments of the present invention—for example but not exclusively by virtue of the seal members 1014 and the location of the fluid communication arrangement 1136 inboard of the ends of the apparatus 1010 permits effective borehole isolation while also increasing the proportion of the borehole B' which can be packed—or in other words reducing the proportion of the borehole B' which, due to the length of the packer apparatus, is typically not packed or which suffers from poor quality packing for the reasons previously described. Embodiments of the apparatus thus reduce the possibility of screen erosion which may otherwise result in screen failure. Moreover, by providing a shorter packer apparatus, embodiments of the apparatus may also permit isolation of shorter borehole intervals, increasing the operators ability to control access from and/or a given formation zone.

The outer body portion 1022 is tubular in construction and the seal members 1014A, 1014B and the activation arrangement 1016 are disposed around the outer body portion 1022 of the apparatus 1010.

The apparatus 1010 further comprises a top sub 1030, a bottom sub 1032.

The top sub 1030 is configured to be coupled to an uphole end portion of the body 1012 and provides mounting for the one or more transport tubes or shunt tubes 1038 for communicating with an uphole end of the conduit 1018.

The bottom sub 1032 is configured to be coupled to a downhole end portion of the body 1012 and provides mounting for one or more transport tubes or shunt tubes 1046 for communicating with a downhole end of the conduit 1018.

Seals 1048, 1050 are provided in respective grooves 1052, 1054 provided in the top sub 1030 and bottom sub 1032 to prevent fluid leakage between the shunt tubes 1038, 1046 and bottom sub 32 and the body 1012.

It will be recognised that the transport tubes/shunt tubes 1038, the conduit 1018 and the transport tubes/shunt tubes 1046 provide a continuous passage, permitting transport of the gravel slurry through the apparatus 1010 while permitting zonal isolation of the borehole B' using the seal members 1014A, 1014B.

As described above, the apparatus 1010 comprises two seal members 1014A, 1014B which are disposed in opposing or back-to-back orientation relative to each other and which each take the form of a cup seal member.

In the illustrated embodiment, the seal members 1014A, 1014B each have a profiled portion 1058A, 1058B. The profiled portions 1058A, 1058B define a corrugated or ribbed profile 1060A, 1060B. Beneficially, the profiled portions 1058A, 1058B assist in conforming the seal members 1014A, 1014B to the borehole B' when the apparatus 1010 is activated by the activation arrangement 1016.

Each seal member 1014A, 1014B is provided with a seal back-up arrangement 1062A, 1062B, the seal back-up arrangement 1062A, 1062B configured to support the seal members 1014A, 1014B in the radially extended position and prevent or reduce the likelihood of extrusion of the seal members 1014A, 1014B which may otherwise detrimentally affect the seal provided between the seal members 1014A, 1014B and the borehole B'.

As described above, the apparatus 1010 comprises an activation arrangement 1016 for transitioning the apparatus 1010 from the first configuration to the second configuration. The apparatus 1010 further comprises a lock arrangement 1102 for retaining the apparatus 1010 in the first configuration until it is required to activate the apparatus 1010.

In the illustrated embodiment, the activation arrangement 1016 comprises two activation pistons 1104A, 1104B. Activation piston 1104A is operatively associated with seal member 1014A. Activation piston 1104B is operatively associated with seal member 1014B. The activation pistons 1104A, 1104B are disposed around an outer surface of the body 1012. In the illustrated embodiment, the activation pistons 1104A, 1104B are each modular in construction, although it will be understood that the activation pistons 1104A, 1104B may alternatively each comprise a unitary construction.

One or more retainer 1114—in the illustrated embodiment in the form of shear pins—retain the activation pistons 1104A, 1104B relative to the body 1012 until the apparatus 1010 is activated.

In use, the activation pistons 1104A, 1104B are axially moveable relative to the body 1012, axial movement of the activation pistons 1104A, 1104B towards the seal members 1014A, 1014B urging the seal members 1014A, 1014B radially outwards; transitioning the apparatus 1010 from the first configuration to the second configuration. A ratchet 1114A, 1114B prevents reverse movement of the activation pistons 1104A, 1104B which would otherwise de-activate the apparatus 1010.

The apparatus 1010 is configured to be locked in the first configuration by a lock arrangement 1102. In the illustrated embodiment, the lock arrangement 1102 comprises two lock sleeves 1106A, 1106B. Lock sleeve 1106A is operatively associated with activation piston 1104A. Lock sleeve 1106B is operatively associated with activation piston 1104B.

Lock sleeve 1106A comprises a shifting profile 1142A for engaging a shifting tool (not shown). Lock sleeve 1106B comprises a shifting profile 1142B for engaging the shifting tool. In use, the shifting profiles 1142A, 1142B are engaged by the shifting tool to shift the lock sleeves 1106A, 1106B axially relative to the body 1012.

Dogs 1108A, 1108B of the lock arrangement 1102 are disposed around the lock sleeves 1106A, 1106B, the lock sleeves 1106A, 1106B preventing radially inwards movement of the dogs 1108, 1108B.

As described above, in operation the apparatus 1010 is run into the borehole B' as part of a completion assembly.

On reaching the target location in the borehole B', a shifting tool is run into the apparatus 1010, the shifting tool engaging and shifting the shifting profiles 1142A,1142B of the lock sleeves 1106A, 1106B axially relative to the body 1012.

Axial movement of the lock pistons 1106A, 1106B relative to the body 1012 de-supports the dogs 1108A, 1108B which are permitted to move radially inwards. The activation pistons 1104A, 1104B are thus freed to move axially with respect to the body 1012 in an uphole direction (to the left as shown in the accompanying drawings) so as to urge the seal members 1014A, 1014B radially outwardly; thereby transitioning the apparatus 1010 from the first configuration to the second configuration. The profiled portions of the seal members 1014A, 1014B ensures a compliant seal is obtained between the seal members 1014A, 1014B and the borehole B', even in instances where the borehole B' is irregular or non-circular.

In the illustrated embodiment, the seal members 1014A, 1014B are activated sequentially, the downhole seal member 1014B activated first and then the uphole seal member 1014A. However, the seal members 1014A, 1014B may alternatively be activated simultaneously, or the uphole seal member 1014 may be activated first.

It should be understood that the embodiments described herein are merely exemplary and that various modifications may be made thereto without departing from the scope of the invention.

What is claimed is:

1. A packer apparatus for use in a borehole packing operation, the packer apparatus forming part of a downhole completion system and comprising:

a body comprising a throughbore, a first end, and a second end, the first end defining an uphole end of the packer apparatus in use and forming a first connector for coupling the packer apparatus to a downhole end of a first sandscreen joint of the downhole completion system, the second end defining a downhole end of the packer apparatus in use and forming a second connector for coupling the packer apparatus to an uphole end of a second sandscreen joint of the downhole completion system;

a plurality of seal members disposed on the body, the seal members comprising:

a first seal member defining an uphole seal member of the packer apparatus in use, and a second seal member defining a downhole seal member of the packer apparatus in use;

an activation arrangement operatively associated with the seal members, the activation arrangement configured to engage the seal members to urge the seal members to a radially extended position relative to the body and thereby reconfigure the packer apparatus from a first configuration to a second configuration, wherein the activation arrangement comprises a piston member for engaging each seal member, the piston member axially moveable relative to the body;

a lock arrangement for locking the packer apparatus in the first configuration, wherein the lock arrangement comprises a lock sleeve and one or more dogs, the packer apparatus configured so that the piston member of the activation arrangement is prevented from axial movement relative to the body by the one or more dogs when the packer apparatus defines the first configuration, wherein the lock sleeve is axially movable relative to the body, the packer apparatus configured so that axial movement of the lock sleeve relative to the body de-supports the one or more dogs which are permitted to move radially inwards, and thereby free the piston member to move axially relative to the body;

a conduit isolated from the throughbore and configured to transport a borehole packing material through the packer apparatus; and a fluid communication arrangement for providing lateral fluid communication through the packer apparatus between the throughbore of the body and an annulus of the borehole, wherein the fluid communication arrangement comprises one or more bores or perforations in the body, and wherein the fluid communication arrangement is disposed axially inboard of the first and second ends of the body, and wherein the fluid communication arrangement is disposed between the first end of the body and the first seal member of the packer apparatus and/or between the second end of the body and the second seal member of the packer apparatus.

2. The packer apparatus of claim 1, wherein the conduit is disposed or formed within the body of the packer apparatus.

3. The packer apparatus of claim 1, wherein each of the seal members comprises a proximal end fixed to the body and comprises a distal end configured to be urged radially outwards by the activation arrangement, such that each of the seal members is configured to define a cup seal in the second, radially extended, configuration of the packer apparatus.

4. The packer apparatus of claim 3, wherein the seal members are disposed on the body in opposing or back-to-back orientation relative to each other.

5. The packer apparatus of claim 1, wherein the body comprises an inner member and an outer member, the conduit disposed between the inner member and the outer member.

6. The packer apparatus of claim 1, wherein a central longitudinal axis of the conduit is offset relative to a central longitudinal axis of the packer apparatus.

7. A method for performing a borehole packing operation, the method comprising:

activating a packer apparatus according to claim 1 from the first configuration to the second configuration by urging the seal members of the packer apparatus to the radially extended position using the activation arrangement operatively associated with the seal members; and directing a borehole packing material through the conduit.

8. A downhole completion system comprising:

the packer apparatus of claim 1;

the first sand screen joint; and the second sand screen joint, wherein the fluid communication arrangement is disposed between the downhole end of the first sandscreen joint and the first seal member of the packer apparatus and/or between the uphole end of the second sandscreen joint and the second seal member of the packer apparatus.

* * * * *